US005564342A

United States Patent [19]

Casetta et al.

[11] Patent Number: 5,564,342

[45] Date of Patent: Oct. 15, 1996

[54] RAILWAY VEHICLE WITH VARIABLE TRIM BODY

[75] Inventors: Claudio Casetta, Beinasco; Paolo Gatti, Turin; Bruno Parussatti, Candiolo, all of Italy

[73] Assignee: Fiat Ferroviaria Spa, Italy

[21] Appl. No.: 519,043

[22] Filed: Aug. 24, 1995

[30] Foreign Application Priority Data

Apr. 7, 1995 [IT] Italy ..... TO95A0274

[51] Int. Cl.[6] ..... B61F 5/00

[52] U.S. Cl. ..... 105/199.2

[58] Field of Search ..... 105/171, 185, 105/199.1, 199.2, 453; 280/112.2

[56] References Cited

U.S. PATENT DOCUMENTS

| | | | |
|---|---|---|---|
| 3,844,225 | 10/1974 | DiMajo | 105/199.2 |
| 5,295,443 | 3/1994 | Bangtsson et al. | 105/199.2 |
| 5,331,903 | 7/1994 | Elia | 105/199.2 |
| 5,454,329 | 10/1995 | Liprandi et al. | 105/199.2 |

FOREIGN PATENT DOCUMENTS

| | | | |
|---|---|---|---|
| 1077781 | 5/1980 | Canada | 105/199.2 |
| 557893 | 9/1993 | European Pat. Off. | 105/199.2 |
| 1071565 | 2/1977 | Italy . | |
| 47672 | 2/1989 | Japan | 105/199.2 |
| 269666 | 10/1989 | Japan | 105/199.2 |
| 4066366 | 3/1992 | Japan | 105/199.2 |

*Primary Examiner*—S. Joseph Morano

*Attorney, Agent, or Firm*—D. Peter Hochberg; Mark Kusner; Michael Jaffe

[57] ABSTRACT

A railway vehicle having a variable trim body, comprising two bogies with respective swinging transverse members pivotally connected to the body, and a control system for controlling roll of the body about its longitudinal axis, by use of linear actuators interposed between the swinging transverse members and the opposite sides of the body and operated through a regulation electronic unit connected to a first transducer device detecting the non-compensated centrifugal acceleration acting on the body, and to a second transducer device comprising at least two angular transducers for detecting the momentary relative angle between each swinging transverse member and the body.

1 Claim, 1 Drawing Sheet

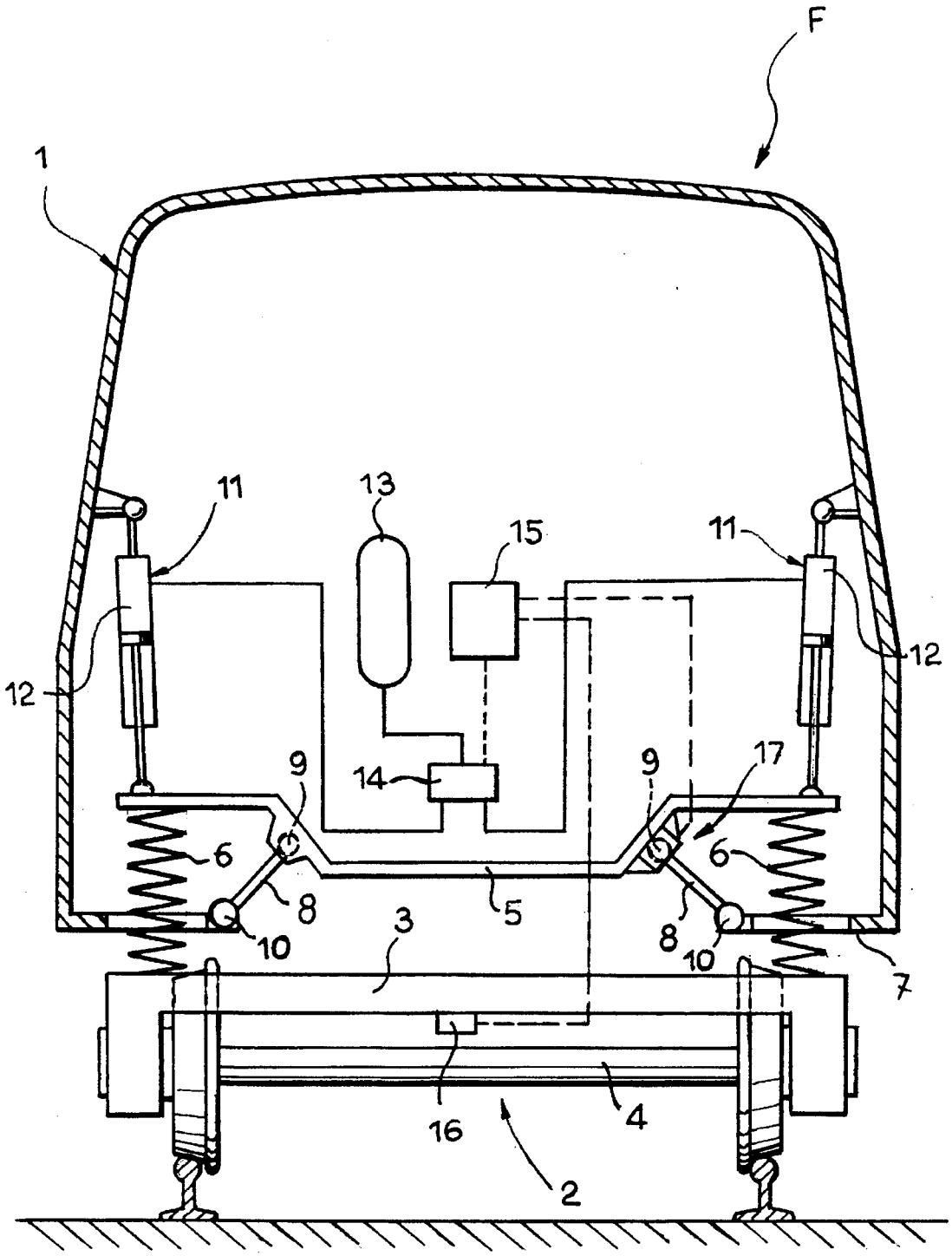
F
1
11
13
15
11
12
12
9
14
9
17
6
6
8
5
8
10
3
10
7
16
4
2

RAILWAY VEHICLE WITH VARIABLE TRIM BODY

BACKGROUND OF THE INVENTION

1. Field of the Invention

The present invention is related to railway vehicles having a variable trim body, of the type comprising two bogies with respective frameworks and swinging transverse members, resilient suspension means between the frameworks of the bogies and the respective swinging transverse members, articulated connection means between each swinging transverse member and the body, and a body roll control system comprising actuator means interposed between said swinging transverse members and the body, a regulation electronic unit operatively associated to said actuator means, and first and second transducer means for detecting respectively the non-compensated centrifugal acceleration acting on the vehicle body and the running condition of the vehicle along entry and exit curve transition sections, and for transmitting corresponding output signals to said regulation electronic unit to pilot said actuator means so as to perform, while the vehicle is running along a curve, rotations of the body around its longitudinal axis tending to compensate said centrifugal acceleration.

The rotation or roll of the body carried out by the control system of the vehicle allows, particularly as far as high-speed railway vehicles are concerned, appreciably enhancing comfort for the passengers, due to the fact that the transverse acceleration felt within the body as the vehicle is running over a curved track is relatively limited.

2. Description of the Prior Art

U.S. Pat. No. 3,844,225 assigned to Fiat Spa discloses a body roll control system for a railway vehicle of the above-referenced type, wherein the first transducer means for detecting the centrifugal acceleration acting on the body comprise an accelerometer. Since the output signal of the accelerometer is hugely disturbed by the transverse motions of the vehicle even during straight travel, owing to hunting phenomena, it is necessary to filter the accelerometer output signals at very low frequencies so as to avoid unacceptable succession of undesired interventions of the body roll control system. This involves as a consequence a delay in the transmission of the actual control for the body rotation, and a reduction of the available time for carrying out the trim variations.

In order to limit such a delay, the above referenced U.S. patent provides employing a gyroscope detecting transverse tilting of one axle of the vehicle front bogie, as the latter enters the parabolic entry and exit transition sections of the track curves. Such tilting is due to the fact that along these parabolic transition sections the outside rail of the track is gradually raised or superelevated relative to the inside rail until reaching its maximum height in the constant-radius curve section, and then returning to the level of the inside rail at the end of the exit transition section.

The gyroscope devices are however affected by the drawback of being delicate and thus of short operation life, as well as expensive, and moreover require complex treating and conditioning circuits of the relative output signals.

To the aim of avoiding the above drawback, Italian patent No. 1.071.565 in the name of Fiat Ferroviaria Savigiiano Spa has proposed to employ, instead of a gyroscope, an angle transducer adapted to detect the momentary relative angle formed in a transverse plane between at least two axles of the vehicle and to generate a corresponding output electrical signal, proportional to said angle, which is fed to the body roll control system.

The advantages deriving from using an angle transducer mainly reside in that such a transducer is less expensive, more resistant and thus affording a longer operation life with respect to the gyroscope, while ensuring at the same time a sufficient output signal promptness.

The solution according to the above-referenced Italian patent contemplates applying the angle transducer directly between two axles of a same bogie, or between two axles belonging to the one and to the other bogie, respectively.

In either case mounting of the angle transducer is constructively complicate; since it involves employing transmission shafts and related universal and telescopic joints between the inductor and rotor members of the angle transducer. Moreover, in both cases the signal of the angle transducer is quite negatively affected, i.e. fouled, by the motions of the secondary suspension interposed between the bogies and the body of the vehicle.

SUMMARY OF THE INVENTION

The object of the present invention is to avoid the above inconveniences, and in particular to provide a railway vehicle with variable trim body of the type set forth at the beginning, wherein the control system of the body rotation or roll is free from undesired interventions due to track unevenness, properly recognizing, while the vehicle is running, the entry and exit curve transition sections and ensuring at the same time high actuating promptness.

According to the invention, this object is achieved essentially by virtue of the fact that said second transducer means comprise at least a pair of angle transducers means detecting the momentary relative angle between said swinging transverse members of the two bogies and the body.

Usually the connecting means between each swinging transverse member and the body comprise swing hangers articulated at the ends thereof to the swinging transverse member and to a transverse load bearing beam fixed under the body, respectively, around respective axis oriented substantially longitudinally relative to the vehicle. According to the invention, said angle transducer means conveniently comprise each an angle transducer including an inductor member and a rotor member rotatable relative to each other and operatively associated to one of the articulation ends of one of said swing hangers of the respective swinging transverse member.

In the variable trim body railway vehicle of the invention, the curve recognizing signal for enabling intervention of the body roll control system is advantageously based upon the difference between the angle signals corresponding to one and to the other bogie.

BRIEF DESCRIPTION OF THE DRAWING

The invention will now be disclosed with reference to the accompanying drawing purely provided by way of non-limiting example, depicting a diagrammatic and simplified vertical cross section view in correspondence of one bogie of a variable trim body railway vehicle according to the invention.

DESCRIPTION OF THE PREFERRED EMBODIMENT

Referring to the drawing, a railway vehicle F essentially comprises a body 1 supported in proximity of its opposite ends by two bogies 2 (only one of which being shown in the drawing), each comprising in a way known per se a framework 3, two wheel and axle sets 4 and a swinging transverse member 5.

Each swinging transverse member 5 is mounted onto the respective bogie 2 substantially in correspondence of the transverse center line thereof, with the interposition of vertical helical springs 6 constituting the vertical and lateral secondary suspension of the vehicle.

The body 1 of the vehicle F is connected, also in a way known per se, to the swinging transverse members 5. Namely, connection between each swinging transverse member 5 and a respective transverse load bearing beam diagrammatically shown as 7, rigidly fixed under the floor of the body 1, is conventionally carried out through a pair of swing hangers 8 each of which is articulated superiorly at 9 to the swinging transverse member 5, and lowerly at 10 to the load bearing beam 7. The articulation axes are normally oriented substantially parallelly to the longitudinal axis of the vehicle F.

It is pointed out that the representation of the figure is to be purely considered as a functional scheme of principle, without a direct correspondence with the actual structural construction of the shown components.

Two fluid pressure linear actuators 11, for instance constituted by hydraulic jacks, are arranged between each swinging transverse member 5 and the respective lateral walls of the body 1. As an alternative, these actuators might be pneumatic jacks. In any case the invention is also applicable to roll control systems of the body 1 employing, instead of fluid pressure jacks, electrical or any other equivalent type actuators The representation of the drawing is to be considered merely diagrammatic also in connection with the arrangement of the jacks 11: in a constructive disposition of the vehicle these jacks are actually as a rule interposed between the corresponding ends of the swinging transverse member 5 and of the load bearing beam 7 fixed to the floor of the body 1.

The upper sides of the cylinders of the two pairs of hydraulic jacks 11 define respective thrust chambers 12 connected to an electro-hydraulic control system of the rotation of the body 1 about a longitudinal axis, so as to vary trim thereof while the vehicle F is running along a curve. Such a rotation or roll along a curve of the body 1 around the longitudinal axis allows, in a way known per se, to compensate the centrifugal force acting on the passengers by means of the lateral component of weight, whereby the transverse acceleration felt by the passengers is relatively limited even in case of high speed travel.

The control system for controlling rotation or roll of the body 1 comprises, also in a way generally known, a source of hydraulic fluid under pressure or power generator 13 which is intended to be connected with the thrust chambers 12 of the hydraulic jacks 11 through a solenoid-valve assembly 14. The solenoid-valve assembly 14, which may be comprised of one or more pressure or flow control valves, is piloted by a regulation electronic unit 15, also of a generally conventional type, which in turn is operatively connected to transducer devices 16; 17 adapted to detect the non-compensated centrifugal acceleration acting on the body 1 and the travel condition along a curve of the vehicle F, respectively, and to supply corresponding output electrical signals to the regulation electronic unit 15 for piloting the solenoid-valve assembly 14.

The transducer devices 16 are constituted in a conventional way by accelerometers applied onto the framework 3 of each bogie 2 in substantial correspondence of the respective centerline thereof.

According to the fundamental feature of the invention, the transducer devices 17 are comprised of at least two angle transducers adapted to detect the momentary relative angle between the swinging transverse member 5 of each bogie and the body 1.

In more detail, the transducer 17 associated to the bogie 2 shown in the drawing is constituted by an angle transducer formed, in a generally conventional way, by an inductor member and by a rotor member rotatable relative to each other, operatively associated to one of the articulated ends (in the shown example the upper articulation end 9) of one of the swing hangers 8 (in the shown example the right one with reference to the drawing). The angle transducer 17 is connected to the regulation electronic unit 15.

An identical angle transducer 17, also connected to the regulation electronic unit 15, is arranged in correspondence of the articulation end 9 of one of the swing hangers 8 (for instance the left one with reference to the drawing) connecting the swinging transverse member 5 of the other bogie 2 to the load bearing beam 7 of the body 1.

The construction of the inductor member and of the rotor member of each angle transducer 17 is not shown in detail nor will be for the sake of brevity specifically described, since it is generally conventional.

In operation, the output signals generated by the two angle transducers 17 are proportional to the relative angles between the respective swing hangers 8 and the corresponding swinging transverse members 5, i.e. between the swinging transverse members 5 and the load bearing beams 7. Following comparison and processing of the output signals generated by the two angle transducers 17 of the two bogies 2, the regulation electronic unit 15 is able to recognize the condition of travel along a curve of the vehicle F. More particularly, from the difference between these output signals the unit 15 enables to determine the run condition of the vehicle over parabolic-incline entry and exit curve transition sections and, consequently, to pilot intervention of the actuators 11 performing roll of the body 1. In order to discriminate the actual presence of an entry or exit curve transition section from a mere track unevenness (skew), and thus avoiding undesired interventions of the body roll control system, it is sufficient to establish a threshold value of the difference between the output signals of the front and rear bogie angle transducers 17, below which the unit 15 does not produce the consent for the system intervention.

Above such threshold value, in response to the amount of the non-compensated centrifugal acceleration obtained through the accelerometric output signals fed by the transducer or transducers 16, the thrust chambers 12 of the jacks 11 corresponding to the lateral side of the body 1 situated inside of the curve are then placed in communication with the power generator 13, while the thrust chambers 12 of the actuators 11 corresponding to the lateral side situated outside of the curve are connected to a discharge, via the solenoid valve assembly 14. Accordingly the body 1 is rotated about its longitudinal axis towards the inside of the curve, thus limiting the transverse acceleration felt by the passengers within the body 1.

Employing the two angle transducers 17, positioned above the springs 6 of the secondary suspension, enables preventing any intervention of the body 1 roll control system which might be due to mere track unevenness, as well as providing more clean and stable signals which are such as to ensure a sufficient actuation promptness of the body roll along a curve.

Naturally the details of construction and the embodiments may be widely varied with respect to what has been disclosed and illustrated, without thereby departing from the scope of the present invention, such as defined in the appended claims. In particular, as already previously pointed out, though the exemplary embodiment such as described and illustrated is related to a control system employing linear fluid pressure actuators, the invention can be equally applicable to control systems making use of actuator of a different type; for instance electrical actuators.

What is claimed is:

1. A railway vehicle having a variable trim body, comprising;

two bogies having respective frameworks and swinging transverse members, resilient suspension means between the frameworks of said bogies and the respective swinging transverse members, articulated connecting means between each swinging transverse member and said body, a body roll control system comprising:

actuator means interposed between said swinging transverse members and said body, a regulation electronic unit operatively associated to said actuator means, and first and second transducer means for detecting respectively the non-compensated centrifugal acceleration acting on the body of the vehicle and the running condition of the vehicle along entry and exit curve transition sections and for transmitting corresponding output signals to said regulation electronic unit to pilot said actuator means so as to perform, while the vehicle is running along a curve rotations of said body about a longitudinal axis tending to compensate said centrifugal acceleration, wherein said second transducer means comprise at least a pair of angle transducer means detecting the momentary relative angle between said swinging transverse members of the two bogies and said body, and transverse load bearing beams fixed to the body, wherein said connecting means between each swinging transverse member and said body comprise swing hangers having respective ends articulated to the swinging transverse member and to a respective transverse load bearing beam, and wherein said angle transducer means comprise each an angle transducer operatively connected at one of the articulation ends of one of said swing hangers of the respective swinging transverse member.

* * * * *